US008884172B2

(12) United States Patent
Lee et al.

(10) Patent No.: US 8,884,172 B2
(45) Date of Patent: Nov. 11, 2014

(54) KEYPAD APPARATUS FOR PORTABLE COMMUNICATION DEVICE

(75) Inventors: Soo-Hyun Lee, Seoul (KR); Seok-Gyu Lee, Yongin-si (KR); Cheol-Hee Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 188 days.

(21) Appl. No.: 13/361,168

(22) Filed: Jan. 30, 2012

(65) Prior Publication Data

US 2012/0193206 A1 Aug. 2, 2012

(30) Foreign Application Priority Data

Jan. 31, 2011 (KR) ..... 10-2011-0009831

(51) Int. Cl.
*H01H 9/26* (2006.01)
*H01H 13/85* (2006.01)

(52) U.S. Cl.
CPC ..... *H01H 13/85* (2013.01); *H01H 2219/056* (2013.01); *H01H 2215/004* (2013.01)
USPC ..... 200/5 A; 200/520; 200/314; 200/329

(58) Field of Classification Search
CPC ..... H01H 13/79; H01H 13/83; H01H 13/85; H01H 2215/004; H01H 2219/06; H01H 2219/062; H01H 2219/036; H01H 2205/024; H01H 2205/032
See application file for complete search history.

(56) References Cited

U.S. PATENT DOCUMENTS

| | | | | |
|---|---|---|---|---|
| 6,373,008 | B1 * | 4/2002 | Saito et al. | 200/310 |
| 6,595,653 | B2 * | 7/2003 | Saito et al. | 362/84 |
| 7,070,349 | B2 * | 7/2006 | Dombrowski et al. | 400/490 |
| 7,718,909 | B2 * | 5/2010 | Masuda | 200/310 |
| 7,777,144 | B2 * | 8/2010 | Wu et al. | 200/313 |
| 7,902,474 | B2 * | 3/2011 | Mittleman et al. | 200/516 |
| 8,022,324 | B2 * | 9/2011 | Liu | 200/314 |
| 2009/0242374 | A1 * | 10/2009 | Ohsumi | 200/5 A |
| 2010/0140069 | A1 * | 6/2010 | Tatehata et al. | 200/314 |

FOREIGN PATENT DOCUMENTS

| | | | | |
|---|---|---|---|---|
| JP | 2007-287347 | * | 11/2007 | H01H 13/702 |

* cited by examiner

*Primary Examiner* — Kyung Lee
(74) *Attorney, Agent, or Firm* — Jefferson IP Law, LLP

(57) ABSTRACT

A keypad apparatus for a portable communication device in which a plurality of pressurizing protrusions are integrated with a plurality of dome switches is provided. To this end, the keypad apparatus includes a keypad comprising a plurality of key buttons, a front frame provided on a top surface of the keypad, a light path provided on a bottom surface of the keypad, and a plurality of dome switches provided on a bottom surface of the light path, such that a respective plurality of pressurizing protrusions are integrated with the plurality of dome switches on top surfaces of the plurality of dome switches.

15 Claims, 4 Drawing Sheets

KEYPAD APPARATUS FOR PORTABLE COMMUNICATION DEVICE

PRIORITY

This application claims the benefit under 35 U.S.C. §119 (a) of a Korean patent application filed in the Korean Intellectual Property Office on Jan. 31, 2011 and assigned Serial No. 10-2011-0009831, the entire disclosure of which is hereby incorporated by reference.

BACKGROUND OF THE INVENTION

1. Field of the Invention

The present invention relates to a keypad apparatus for a portable communication device. More particularly, the present invention relates to a keypad apparatus for a portable communication device in which a plurality of pressurizing protrusions are integrated with a plurality of dome switches instead of with a keypad.

2. Description of the Related Art

Generally, the term "portable communication device" denotes a device by which wireless communication can be performed while the device is being carried. Examples of a portable communication device include a Hand Held Phone (HHP), a Cordless Telephone (CT-)2 cellular phone, a digital phone, a Personal Communications Systems (PCS) phone, and a Personal Digital Assistant (PDA), which are sorted into various types according to their shapes. For example, the wireless terminals are sorted into a bar type, a flip type, a folder type, and a sliding type according to their shapes. The above-mentioned portable terminals always include an antenna apparatus, a data input/output device, and a data transceiver. For the data input device, a keypad assembly allowing data input through a finger press is generally used; for the data output device, a display device is used.

FIG. 1 is a front view showing a keypad apparatus for a portable communication device according to the prior art. FIG. 2 is a side cross-sectional view showing a structure of a keypad apparatus for a portable communication device according to the prior art.

Referring to FIGS. 1 and 2, a keypad assembly 1 includes a keypad 2 including a plurality of key buttons 2*a*, a board 3, formed under the keypad 2 and including a plurality of dome switches 3*a* for inputting a signal by pressing of the key buttons 2*a* and a plurality of light-emitting devices (not shown), and a light path (or waveguide) 4 disposed between the keypad 2 and the board 3 to uniformly diffuse light emitted from the light emitting devices.

As shown in FIGS. 1 and 2, on a bottom surface of the keypad 2 are formed a plurality of pressurizing protrusions 2*b* for pressing and pressurizing the plurality of dome switches 3*a*, respectively, and between the key buttons 2*a* is configured a front frame 5.

The keypad 2 is made of a silicon material and a thickness of the keypad 2 needs to be more than 0.9 mm due to characteristics of silicon and formation of the pressurizing protrusions 2*b*.

However, in the keypad assembly 1, when the keypad 2 having a thickness of less than 0.9 mm is pressed, pressing of the pressurizing protrusions 2*b* of the keypad 2 deviates from the corresponding dome switches 3*a* due to the characteristics of silicon, making accurate signal input difficult. For this reason, the thickness of the keypad assembly 1 needs to be more than 0.9 mm, thus increasing the overall thickness of the product.

Moreover, a user, when pressing the keypad 2, may also feel the pressurizing protrusion 2*b*, such that a sense of clicking of the product is degraded.

The front frame 5 of the prior art is made of Poly-Carbonate (PC) or PC+Glass Fiber (GF).

The minimum thickness of the front frame 5 made of the foregoing material needs to be more than 0.6 mm. Otherwise, insufficient filling or shrinking may occur.

As such, the thickness of the keypad 2 has to be more than 0.9 mm and the thickness of the front frame 5 has to be more than 0.6 mm, both of which contribute to an increased thickness of the product.

Therefore, to reduce the size of a product by reducing the thickness of the keypad 2 and the thickness of the front frame 5, the pressurizing protrusions 2*b* need to be integrated with the plurality of dome switches 3*a*, instead of with the keypad 2, and a material capable of reducing the thickness of the front frame 5 to 0.6 mm or less needs to be used.

SUMMARY OF THE INVENTION

Aspects of the present invention are to address at least the above-mentioned problems and/or disadvantages and to provide at least the advantages described below. Accordingly, an aspect of the present invention is to provide a keypad apparatus for a portable communication device in which a plurality of pressurizing protrusions are integrated with a plurality of dome switches to reduce a thickness of a keypad, thereby improving slimness of a product.

Another aspect of the present invention is to provide a keypad apparatus for a portable communication device in which a plurality of pressurizing protrusions are integrated with a plurality of dome switches to prevent the pressing of the pressurizing protrusions from deviating from the dome switches, thereby improving signal transmission between the keypad and the dome switches.

Yet another aspect of the present invention is to provide a keypad apparatus for a portable communication device, in which a plurality of pressurizing protrusions are integrated with a plurality of dome switches to prevent a user from feeling the pressurizing protrusions when pressing the keypad, thereby improving a sense of clicking of a product.

In addition, another aspect of the present invention is to provide a keypad apparatus for a portable communication device, in which a front frame is made of a stainless steel material to prevent insufficient filling or shirking of the front frame and to reduce a thickness of the front frame to 0.6 mm or less, thus improving slimness of a product.

Furthermore, another aspect of the present invention is to provide a keypad apparatus for a portable communication device in which a top surface of a front frame can be coated with various colors, thereby making an exterior design of a keypad elegant.

Another aspect of the present invention is to provide a keypad apparatus for a portable communication device, in which a plurality of pressurizing protrusions are integrated with a light path to reduce a thickness of the keypad and a thickness of a front frame, thereby further improving slimness of a product.

According to an aspect of the present invention, a keypad apparatus for a portable communication device is provided. The keypad apparatus includes a keypad including a plurality of key buttons, a front frame provided on a top surface of the keypad, a light path provided on a bottom surface of the keypad, and a plurality of dome switches provided on a bottom surface of the light path, such that a respective plurality of pressurizing protrusions are integrated with the plurality of dome switches on top surfaces of the plurality of dome switches.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
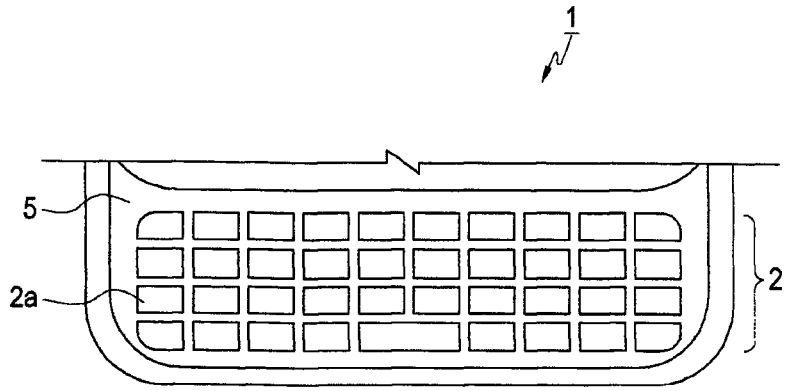
FIG.1 (PRIOR ART)
FIG. 1 is a front view showing a keypad apparatus for a portable communication device according to the prior art.
Figure 2:
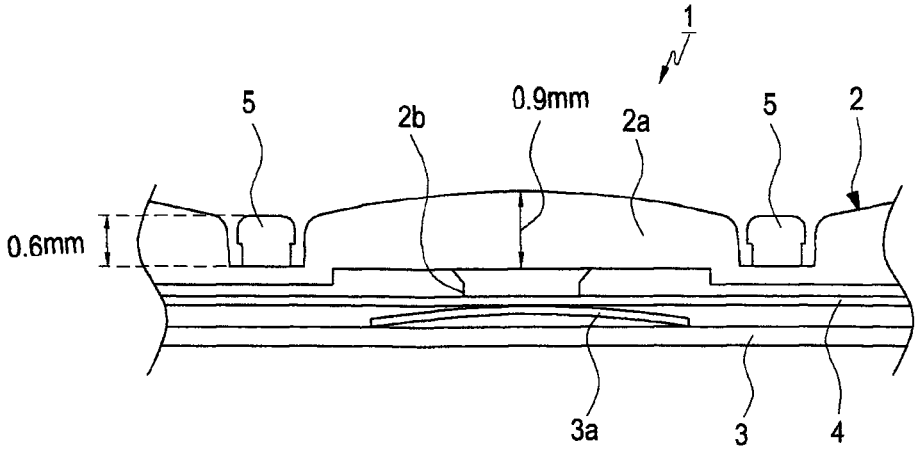
FIG.2 (PRIOR ART)
FIG. 2 is a side cross-sectional view showing a structure of a keypad apparatus for a portable communication device according to the prior art.
Figure 3:
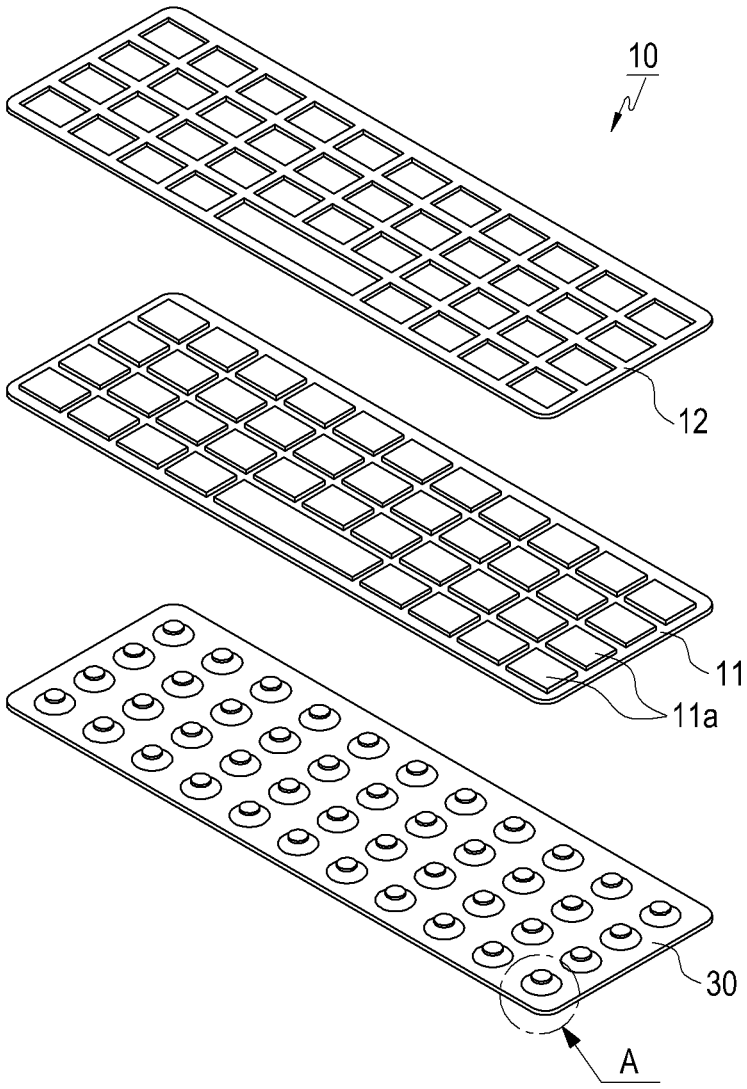
FIG. 3 is an exploded perspective view showing a structure of a keypad apparatus for a portable communication device according to an exemplary embodiment of the present invention.
Figure 4:
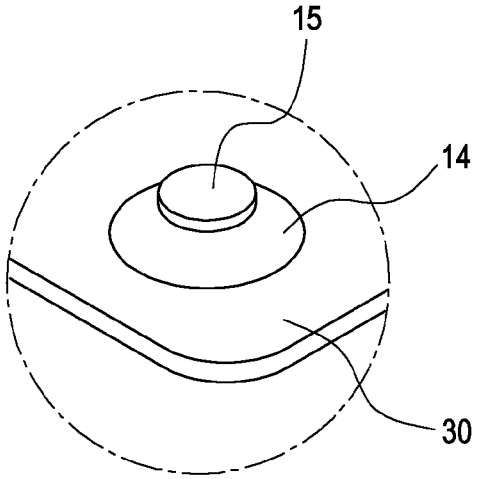
FIG. 4 is an enlarged perspective view of a portion of FIG. 3 according to an exemplary embodiment of the present invention.
Figure 5:
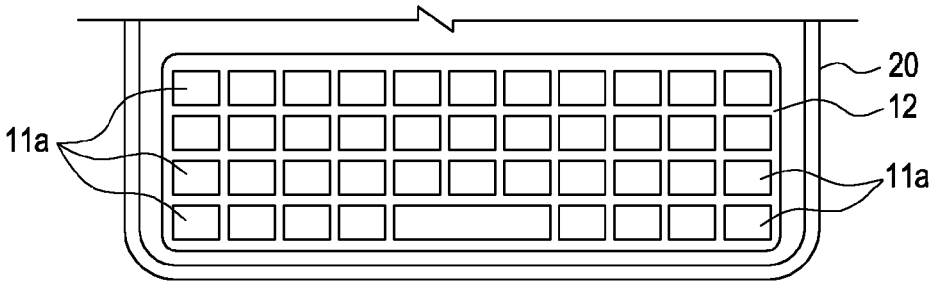
FIG. 5 is a front view showing a coupled state of a keypad apparatus for a portable communication device according to an exemplary embodiment of the present invention.
Figure 6:
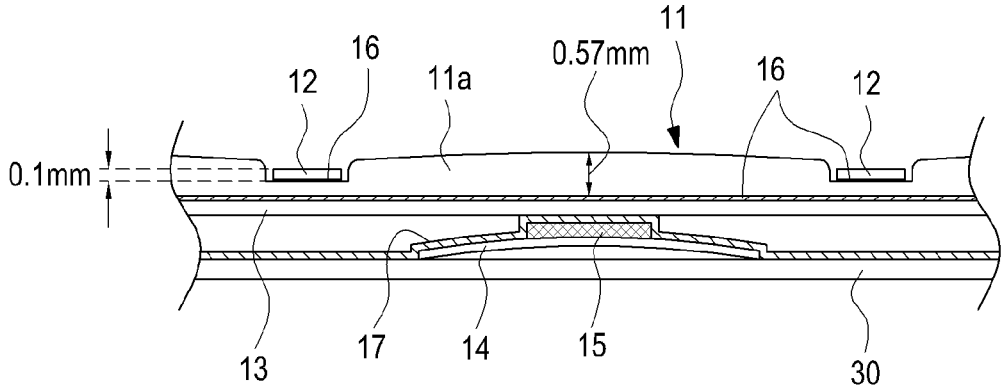
FIG. 6 is a side cross-sectional view showing a coupled state of a keypad apparatus for a portable communication device according to an exemplary embodiment of the present invention.
Figure 7:
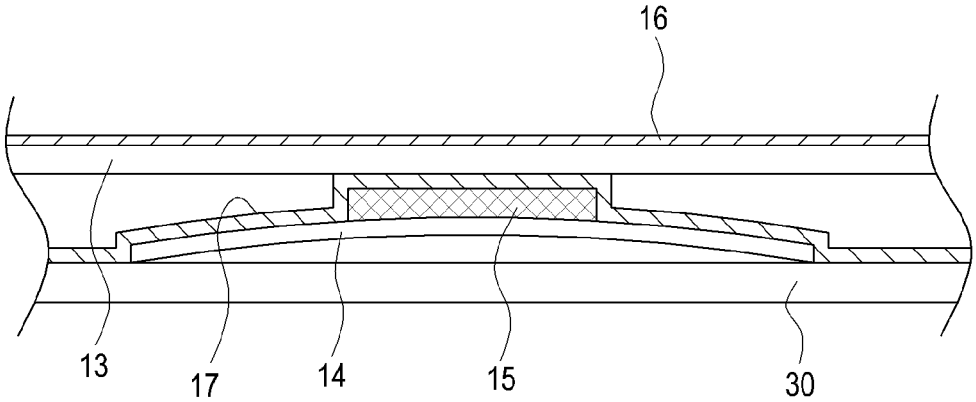
FIG. 7 is an enlarged side cross-sectional view showing a dome switch of a keypad apparatus for a portable communication device according to an exemplary embodiment of the present invention.

FIG. 3 is an exploded perspective view showing a structure of a keypad apparatus for a portable communication device according to an exemplary embodiment of the present invention, FIG. 4 is an enlarged perspective view of a portion of FIG. 3, FIG. 5 is a front view showing a coupled state of a keypad apparatus for a portable communication device according to an exemplary embodiment of the present invention, FIG. 6 is a side cross-sectional view showing a coupled state of a keypad apparatus for a portable communication device according to an exemplary embodiment of the present invention, and FIG. 7 is an enlarged side cross-sectional view showing a dome switch of a keypad apparatus for a portable communication device according to an exemplary embodiment of the present invention.

Referring to FIGS. 3 through 7, a keypad apparatus 10 for a portable communication device may include a keypad 11 including a plurality of key buttons 11*a*, a front frame 12, a light path 13, and a plurality of dome switches 14. The keypad 11 is provided on a main body 20 of the portable communication device, such that pressing of the key buttons 11*a* by a user's finger, and the like, pressurizes and presses the dome switches 14. The front frame 12 is provided on a top surface of the keypad 11 and may be coated with various colors. The light path 13 is provided on a bottom surface of the keypad 11 to diffuse light emitted from a light emitting device (not shown) provided on a Printed Circuit Board (PCB) 30. On a top surface of each dome switch 14 is provided a pressurizing protrusion 15 to be pressed together with the light path 13 by pressing of the keypad 11. The dome switches 14 are provided on a bottom surface of the light path 13 and on a top surface of the PCB 30.

As shown in FIGS. 6 and 7, the keypad 11 and the front frame 12 are attached to each other using a double-sided tape 16, a thickness of which is about 0.05 mm.

In an exemplary implementation, the pressurizing protrusions 15 are formed by hardening an Ultra-Violet (UV) resin using a UV device (not shown). However, the pressurizing protrusions 15 may also be formed of resins other than a UV resin, such as a silicon resin.

As shown in FIGS. 6 and 7, on the surface of the dome switches 14 is formed a coating layer 17 to protect and insulate the pressurizing protrusions 15 and the dome switches 14.

As shown in FIG. 6, a thickness of the keypad 11 is about 0.57 mm and a thickness of the front frame 12 is about 0.1 mm.

In an exemplary implementation, the keypad 11 is an Elastomer Film (EF) keypad which is manufactured by inserting a Poly Urethane (PU) film or a Poly Ethylene Terephthalate (PET)-PU laminated film into a mold and injecting silicon into the mold.

In an exemplary implementation, the front frame 12 may be made of stainless steel. However, the front frame 12 may also be made of materials other than stainless steel such as aluminum, tungsten, etc.

Figure 8:
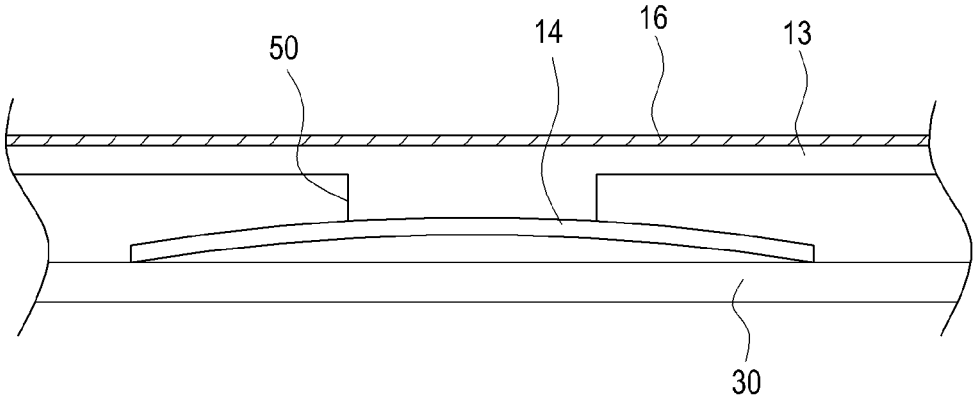
FIG. 8 is an enlarged side cross-sectional view showing another embodiment of a light path of a keypad apparatus for a portable communication device according to an exemplary embodiment of the present invention.

FIG. 8 is an enlarged side cross-sectional view showing another embodiment of a light path of a keypad apparatus for a portable communication device according to an exemplary embodiment of the present invention.

As shown in FIG. 8, a keypad apparatus for a portable communication device may include a keypad 11 including a plurality of key buttons 11*a*, a front frame 12, a light path 13, a plurality of dome switches 14 and a plurality of pressurizing protrusions 50. The keypad 11 is provided on a main body 20 of the portable communication device, such that pressing of the key buttons 11*a* by a user's finger, and the like, pressurizes and presses the dome switches 14. The front frame 12 is provided on a top surface of the keypad 11 and may be coated with various colors. The light path 13 is provided on a bottom surface of the keypad 11 to diffuse light emitted from a light emitting device (not shown) provided on a Printed Circuit Board (PCB) 30. The bottom surface of the light path 13 is integrated with the plurality of pressurizing protrusions 50 to pressurize the dome switches 14.

With reference to FIGS. 3 through 8, a description will now be made of an operation of the above-described keypad apparatus 10 for the portable communication device according to an exemplary embodiment of the present invention.

As shown in FIGS. 3 through 7, the keypad apparatus 10 for the portable communication device includes the keypad 11 including the plurality of key buttons 11*a*, the front frame 12, the light path 13, and the plurality of dome switches 14.

In an exemplary implementation, the keypad 11 may be an EF keypad which is manufactured by inserting a PU film or a PET-PU laminated film into a mold and injecting silicon into the mold.

As shown in FIG. 6, the thickness of the EF keypad 11 is about 0.57 mm.

In an exemplary implementation, the top surface of the EF keypad 11 is clear-coated and the front frame 12 provided on the top surface of the EF keypad 11 is formed by etching and color-coating.

As shown in FIG. 6, the thickness of the front frame 12 is about 0.1 mm. Herein, the front frame 12 is formed of stainless steel to have a thickness of about 0.1 mm.

As shown in FIGS. 6 and 7, the EF keypad 11 and the front frame 12 are attached to each other by using the double-sided tape 16. On the bottom surface of the EF keypad 11 is provided the light path 13.

In an exemplary implementation, the plurality of pressurizing protrusions 15 are integrated with the dome switches 14 by hardening a UV resin on the top surfaces of the dome switches 14.

In this state, as shown in FIGS. 6 and 7, on the surface of the dome switches 14 is formed the coating layer 17 for protecting and insulating the pressurizing protrusions 15 and the dome switches 14.

As shown in FIG. 7, the dome switches 14 with which the pressurizing protrusions 15 are integrated are provided on the bottom surface of the light path 13.

As shown in FIGS. 6 and 7, the thickness of the front frame 12 made of stainless steel may be less than 0.6 mm as in the prior art and less than or equal to 0.1 mm. Also, the thickness of the keypad 11 is reduced from 0.9 mm or more to 0.6 mm or less by integrating the pressurizing protrusions 15 with the dome switches 14, thereby preventing a user from feeling the pressurizing protrusions 15 during pressing of the keypad 11 and thus improving a sense of clicking of a product.

As shown in FIG. 6, the pressurizing protrusions 15 integrated with the dome switches 14 are configured to be separated from the keypad 11, such that a height of the pressurizing protrusion 15 can be reduced from 0.35 mm or more as in the prior art to 0.15 mm, thereby improving slimness of a product.

It has been described that the keypad apparatus 10 according to an exemplary embodiment of the present invention is applied to a portable communication device as a representative application example. However, the portable communication device is not limited to a mobile communication terminal and may be any of various types of terminals to which the keypad apparatus 10 is applicable, such as a bar-type terminal, a folder-type terminal, a sliding-type terminal, a swing-type terminal, and so forth.

Examples of the portable communication device may include not only mobile communication terminals operating according to communication protocols corresponding to various communication systems, but also any information communication apparatuses and multimedia apparatuses such as Portable Multimedia Players (PMPs), MPEG-1 or MPEG-2 Audio Layer III (MP3) players, digital broadcasting players, Personal Digital Assistants (PDAs), smart phones, and so forth, and their application apparatuses.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A keypad apparatus for a portable communication device, the keypad apparatus comprising:

a keypad comprising a plurality of key buttons;

a front frame provided on a top surface of the keypad;

a light path provided on a bottom surface of the keypad;

a plurality of dome switches provided on a bottom surface of the light path, such that a respective plurality of pressurizing protrusions are integrated with the plurality of dome switches on top surfaces of the plurality of dome switches; and a coating layer provided on the surface of the dome switches to protect and insulate the pressurizing protrusions and the dome switches, the coating layer being provided on at least three surfaces of each of the plurality of pressurizing protrusions.

2. The keypad apparatus of claim 1, wherein the keypad and the front frame are attached to each other by a double-sided tape.

3. The keypad apparatus of claim 2, wherein a thickness of the double-sided tape is approximately 0.05 mm.

4. The keypad apparatus of claim 1, wherein the plurality of pressurizing protrusions are formed by hardening an Ultra-Violet (UV) resin.

5. The keypad apparatus of claim 1, wherein a thickness of the keypad is approximately 0.57 mm.

6. The keypad apparatus of claim 1, wherein a thickness of the front frame is approximately 0.1 mm.

7. The keypad apparatus of claim 1, wherein the keypad comprises an Elastomer Film (EF) keypad, and the EF keypad is manufactured by inserting at least one of a Poly Urethane (PU) film and a Poly Ethylene Terephthalate (PET)-PU laminated film into a mold and injecting silicon into the mold.

8. The keypad apparatus of claim 1, wherein the front frame comprises stainless steel.

9. The keypad apparatus of claim 1, wherein color-coating is applied onto a top surface of the front frame.

10. The keypad apparatus of claim 1, wherein the front frame comprises at least one of aluminum and tungsten.

11. The keypad apparatus of claim 1, further comprising a Printed Circuit Board (PCB) on which the plurality of dome switches are provided.

12. The keypad apparatus of claim 11, wherein the PCB comprises one or more light emitting devices.

13. A keypad apparatus for a portable communication device, the keypad apparatus comprising:

a keypad comprising a plurality of key buttons;

a front frame provided on a top surface of the keypad;

a light path provided on a bottom surface of the keypad;

a plurality of pressurizing protrusions integrated on a bottom surface of the light path; and a coating layer provided on at least three surfaces of each of the plurality of pressurizing protrusions to protect and insulate the plurality of pressurizing protrusions.

14. The keypad apparatus of claim 1, wherein the coating layer is in direct contact with the surface of the dome switch along the length of the dome switch from the dome switch's contact with a Printed Circuit Board (PCB) to the pressurizing protrusions.

15. The keypad apparatus of claim 14, wherein the coating layer is in direct contact with three sides of the pressurizing protrusions.

* * * * *